United States Patent [19]

Pringle

[11] Patent Number: 4,986,357

[45] Date of Patent: Jan. 22, 1991

[54] WELL TOOL HAVING A VARIABLE AREA HYDRAULIC ACTUATOR

[76] Inventor: Ronald E. Pringle, 12030 White Cap, Houston, Tex. 77072

[21] Appl. No.: 506,313

[22] Filed: Apr. 9, 1990

[51] Int. Cl.[5] ..... E21B 34/10

[52] U.S. Cl. ..... 166/319; 166/321; 166/332; 251/62; 92/6 R

[58] Field of Search ..... 166/319, 321, 324, 332, 166/375; 251/62, 63.5, 63.6; 92/6 R, 177

[56] References Cited

U.S. PATENT DOCUMENTS

| | | | |
|---|---|---|---|
| 2,710,077 | 6/1955 | Fabel et al. | 92/177 |
| 3,254,837 | 6/1966 | Falconer | 92/6 R |
| 4,048,905 | 9/1977 | Souslin | 92/85 B |
| 4,080,871 | 3/1978 | Katz et al. | 92/6 R |
| 4,161,219 | 7/1979 | Pringle | 166/324 |
| 4,252,197 | 2/1981 | Pringle | 251/62 |
| 4,621,695 | 11/1986 | Pringle | 166/321 |
| 4,676,307 | 6/1987 | Pringle | 166/324 |

*Primary Examiner*—Bruce M. Kisliuk

*Attorney, Agent, or Firm*—Fulbright & Jaworski

[57] ABSTRACT

A subsurface well tool having a hydraulic piston and cylinder assembly actuator which is adapted to be connected to and controlled by a hydraulic control line extending to the well surface. The assembly has a cross-sectional area exposed to the hydraulic control fluid which increases in one direction of movement of the assembly and decreases in the opposite direction for reducing surface operating pressure problems. Preferably, one of the piston and cylinder includes a tapered surface, and includes a flexible seal between the piston and cylinder.

14 Claims, 5 Drawing Sheets

WELL TOOL HAVING A VARIABLE AREA HYDRAULIC ACTUATOR

BACKGROUND OF THE INVENTION

The present invention is directed to subsurface well tools, for example only, safety valves, which utilize a hydraulic piston and cylinder actuator. The piston and cylinder assembly of the present invention has a cross-sectional area exposed to hydraulic fluid in a control line in which the area exposed to the control fluid increases in one direction of movement of the hydraulic assembly and decreases in the opposite direction of movement.

As the setting depths of hydraulically actuated well tools, such as safety valves, continues to increase, the energy required to move the well tool against the hydrostatic head acting on the hydraulic actuator also increases. For example, on conventional safety valves, suitable biasing means, such as a gas chamber or more usually a power spring, acts on the hydraulic actuator to overcome the hydrostatic force. One method of increasing the setting depth is set forth in U.S. Pat. No. 4,161,219 of reducing the hydraulic area of the hydraulic actuator which allows the existing biasing forces to overcome greater hydrostatic heads. However, there are practical limits to maximizing biasing forces such as springs, and minimizing the hydraulic areas of a hydraulic piston and cylinder assembly. Generally, to move a small hydraulic piston and cylinder assembly against a high hydrostatic head requires a strong spring which results in a high "spread" in the operating pressure to move the well tool from a first position to a second position. This increased spread increases the problem of (1) surface operating pressures, (2) the biasing means, such as springs, which require very high pounds of force and length and become quite expensive, and (3) the valve increases in length and expense because of a required longer spring.

The present invention is directed to a subsurface well tool having a hydraulic actuator with a variable hydraulic area. That is, the hydraulic assembly includes a cross-sectional area exposed to hydraulic control fluid in which the area increases in one direction of movement of the assembly and decreases in the opposite direction of movement. This change in hydraulic area, upon movement of the hydraulic actuator, reduces the operating pressure spread thereby reducing surface operating pressure problems, and decreases the size and expense of the biasing means as well as the well tool.

SUMMARY

The present invention is directed to a subsurface well tool having a housing and a hydraulic piston and cylinder assembly actuator. The piston and cylidner assembly is adapted to be connected to a hydraulic control line extending to the well surface The assembly includes a cross-sectional area exposed to hydraulic fluid in the control line, and the area increases in one direction of movement of the assembly and decreases in the opposite direction.

Yet another object of the present invention is wherein one of the piston and cylinder includes a tapered surface. Either the piston and/or the cylinder may include a tapered surface. Preferably, a flexible seal is provided between the piston and cylinder.

Another object of the present invention is wherein the cross-sectional area exposed to the hydraulic fluid in the control line increases in a direction extending away from the control line.

A further object of the present invention is wherein the well tool includes a valve moving between open and closed positions by the actuator and wherein the cross-sectional area exposed to the hydraulic fluid in the control line increases in the direction of opening of the valve by the actuator.

A still further object is wherein in a further embodiment of the invention, one of the piston and cylinder includes a tapered surface, and includes a seal between the piston and cylinder on opposite sides of the control line.

Yet in a further embodiment, one of the piston and cylinder includes a tapered surface and the assembly includes a flexible hydraulic diaphragm positioned between the piston and cylinder.

A still further object of the present invention is the provision of a subsurface well safety valve for controlling fluid fluid through a well conduit including a housing having a bore and a valve closure member in the bore moving between open and closed positions for controlling fluid flow through the bore. A flow tube telescopically moves in the housing for controlling the movement of the valve closure member. Biasing means are provided for moving the tubular member in a direction to close the valve. A piston and cylinder assembly is provided in the housing contacting and moving the tubular member. The assembly is adapted to be connected to a hydraulic control line extending to the well surface. The assembly has a cross-sectional area exposed to the hydraulic fluid in the control line in which the area increases in the direction of the movement of the assembly in opening the valve and decreases in the opposite direction.

Still a further object of the present invention is wherein one of the piston and cylinder assemblies in the safety valve includes a tapered surface. Preferably, a flexible seal is provided between the piston and cylinder.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

While the present invention will be described in connection with a subsurface flapper type tubing safety valve, for purposes of illustration only, the present invention is applicable to other types of well tools such as packers, circulating sleeves, hydraulically operated gas lift valves, pilot valves, and chemical injection valves.

Figure 1A:
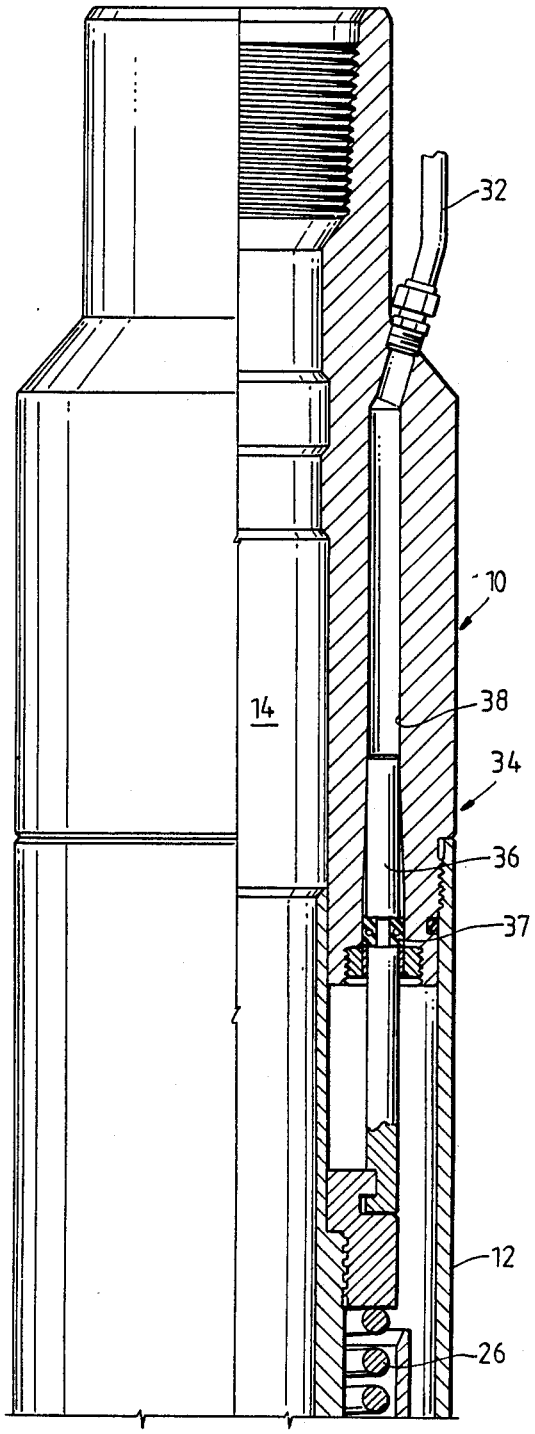
FIGS. 1A and 1B are continuations of each other and form an elevational view, in quarter section, of one embodiment of the present invention.
Figure 1B:
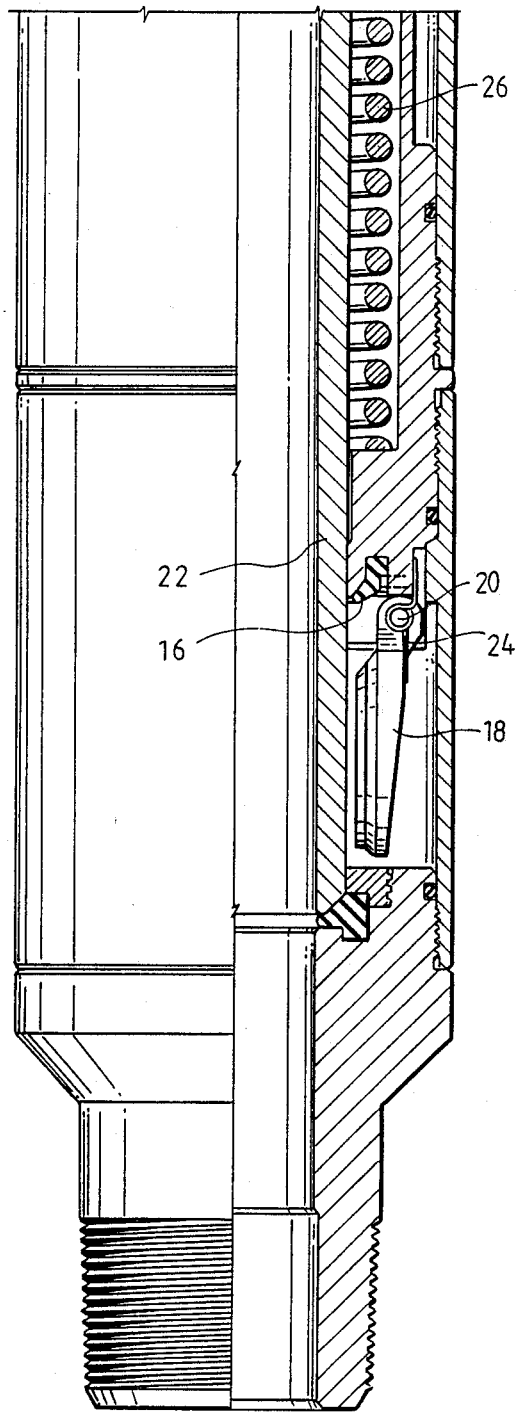

Referring now to the drawings, particularly to FIGS. 1A and 1B, the reference numeral 10 generally indicates a subsurface tubing safety valve of the present invention which includes a body or housing 12 which is adapted to be connected in a well tubing to permit well production therethrough under normal operating conditions, but in which the safety valve 10 may close or be closed in response to abnormal conditions.

The valve 10 includes a bore 14, an annular valve seat 16 positioned about the bore 14, and a valve closure element such as a flapper valve element 18 connected to the body by a pivot pin 20.

A flow tube 22 is telescopically movable in the body 12 and through the valve seat 16. As best seen in FIG. 1B, when the flow tube 22 is moved to a downward position, the tube 22 pushes the flapper 18 away from the valve seat 16. Thus, the valve 10 is held in the open position so long as the tube 22 is in the downward position. When the tube is moved upwardly, the flapper 18 is allowed to move upwardly onto the seat 16 by the action of a spring 24, and also by the action of fluid flow moving upwardly through the bore 14.

The flow tube 22 is biased in an upward position by any suitable means such as a gas chamber or here shown as spring 26 for yieldably urging the flow tube 22 in an upward direction to release the flapper 18 for closing the valve 10. The safety valve 10 is controlled by the application or removal of a pressurized fluid, such as a hydraulic fluid, through a control path or line such as line 32 extending to the well surface or the casing annulus. The control fluid is applied to a hydraulic piston and cylinder assembly generally indicated by the reference numeral 34 which includes a piston 36 movable relative to a cylinder 38, one of which, here shown as the piston 36, is connected to the flow tube 22. A seal 37 is provided between the piston 36 and cylinder 38, here shown on the piston 36. If desired, the piston 36 could be fixed and the cylinder movable and connected to the flow tube 22. The safety valve 10 is controlled by the application or removal of pressurized hydraulic fluid through the control line 32 to supply and vent hydraulic operating fluid from the piston and cylinder assembly 34. When pressurized fluid is supplied to the assembly 34, the tubular member 22 moves downwardly to open the valve 10. When hydraulic pressure is vented from the line 32, the biasing means, including the spring 26, and fluid pressure in the bore 14 passing around the flow tube 22 and acting on the underside of the piston 36, moves the tubular member 22 upwardly to allow the valve 10 to close. The above description is generally disclosed in U.S. Pat. No. 4,161,219.

As previously indicated, the biasing means, such as the power spring 26, must be sufficiently strong to overcome the hydrostatic head in the control line 32 acting on the top of the piston and cylinder assembly 34. Of course, the hydrostatic force may be overcome by increasing the biasing force of the spring 26 and/or by reducing the cross-sectional area of the piston and cylinder assembly 34 that is exposed to the hydraulic control fluid. However, there is a practical limit to the output from the spring 26 and/or the smallest hydraulic working area that can be provided in the hydraulic assembly 34.

For example, to set a safety valve at 10,000 feet, its closing pressure must exceed the maximum fluid gradient encountered at that depth, for example, 0.5 to 0.7 psi/ft., or 5000 to 7000 psi. Springs designed to move a small piston against such a high hydrostatic head to close the safety valve must have a very high spring rate. The spring rate is defined generally as pounds of force resistance per inch of travel to move the valve 10 from the closed position to the open position. For example, this could be 100 pounds. Therefore, in a flapper type safety valve in which 8 inches of travel are required, this would result in 800 pounds of resistance to open the valve from the closed position Using a small hydraulic chamber working area such as 0.200 square inches would require a pressure of 4000 psi to move the valve from the closed position to the open position. This is generally referred to as "spread" in the operating pressure of a safety valve.

Surface operating pressure can be a problem when (1) well pressure is high (2) the safety valve is set deep with high operating "spread". Conventional safety valves have a tubing pressure effect (i.e., 1 to 1 ratio with control pressure) meaning the control pressure must first equal tubing pressure and then additional pressure is applied to open the safety valve, +approximately 500 psi safety factor to hold the valve open. This requires expensive high pressure surface operating equipment. In some cases actual well bore pressure is close to the rated tree and equipment working pressures. Use 3,000 psi working pressure as an example. If the tubing production pressure in the bore 14 is 2,900 psi with 3,000 psi working pressure equpment at the surface, and the safety valve 10 is set at 3000 ft. with a spread from close to open of 4,000 psi, the control panel must be required to pressure up to tubing pressure (2,900 psi)+4,000 psi=6,900 psi −hydrostatic head pressure 1,500 psi (@3,000 ft)=5,400 psi+500 psi safety factor equaling 5,900 psi surface operating pressure for 3,000 psi rated system.

It is a feature of the present invention to provide a hydraulic piston and cylinder assembly having a cross-sectional area, that as movement occurs, the cross-sectional area exposed to the hydraulic fluid in the control line 32 increases and decreases resulting in the elimination or minimizing the safety valve 10 operating pressure "spread".

Figure 3:
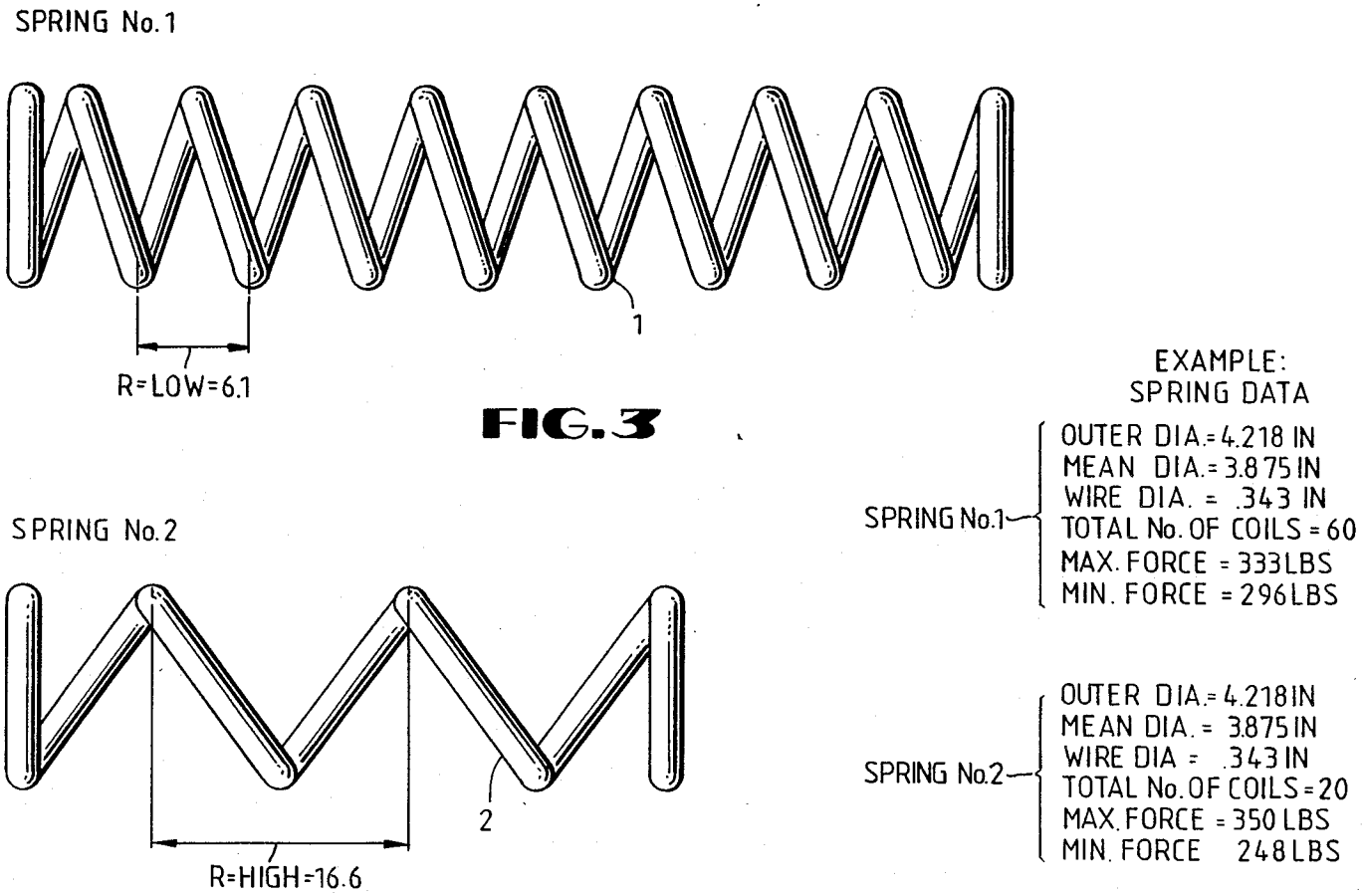
FIG. 3 is a comparison between a conventional spring and a spring used in the present invention.

Another problem of conventional safety valves is that in conventional safety valves to prevent or minimize "spread", the power springs 26 are designed with a maximum number of coils and as much free length as economically possible to reduce the spring rate from close to open. Power springs in safety valves are made of expensive, exotic material, such as MP-35 N, at $50 per pound. Referring to FIG. 3, a comparison is provided of a conventional spring 1 having a spring rate of 6.1 lbs. when used at a setting depth of 10,000 feet in which the hydraulic piston and cylinder working area has a cross-sectional area of 0.046 square inches. The spring 1 having the data therein indicated would cost approximately $2,000. However, by using the present invention, as will be more fully described hereinafter a spring 2 could be used in the same valve having a spring rate of 16.6 lbs. but which would only cost $666.

In addition, because the spring 2 is considerably shorter than the spring 1, the overall length of the safety valve 10 could be reduced at a considerable saving. For example, comparing spring 1 with spring 2 it is noted that spring 2 has only 20 coils instead of 60 and has a length and weight approximately one third of spring 1.

Referring now to FIGS. 1A and 1B, a conventional valve having a hydraulic working area of 0.196 square inches (0.500 inch o.d.) set at a depth of 1,600 feet with a hydrostatic head of 800 psi would have an opening pressure of approximately 1,234 psi above the seal 37 and a closing pressure of approximately 816 psi thereby having a 418 psi spread. It is to be noted that the opening pressure is always greater than the closing pressure for conventional valves.

However, as previously discussed, the present invention is directed to providing a hydraulic actuator for a well tool in which the hydraulic cross-sectional area that is exposed to the hydraulic fluid in the control line 32 increases in the direction of movement of the assembly in one direction and decreases in the opposite direction. Proper dimensioning of the change in the hydraulic area can result in minimizing or even the elimination of the operating pressure "spread". That is, the valve opening pressure above seal 37 can be made the same as or even less than the valve closing pressure above the seal.

Figure 2:
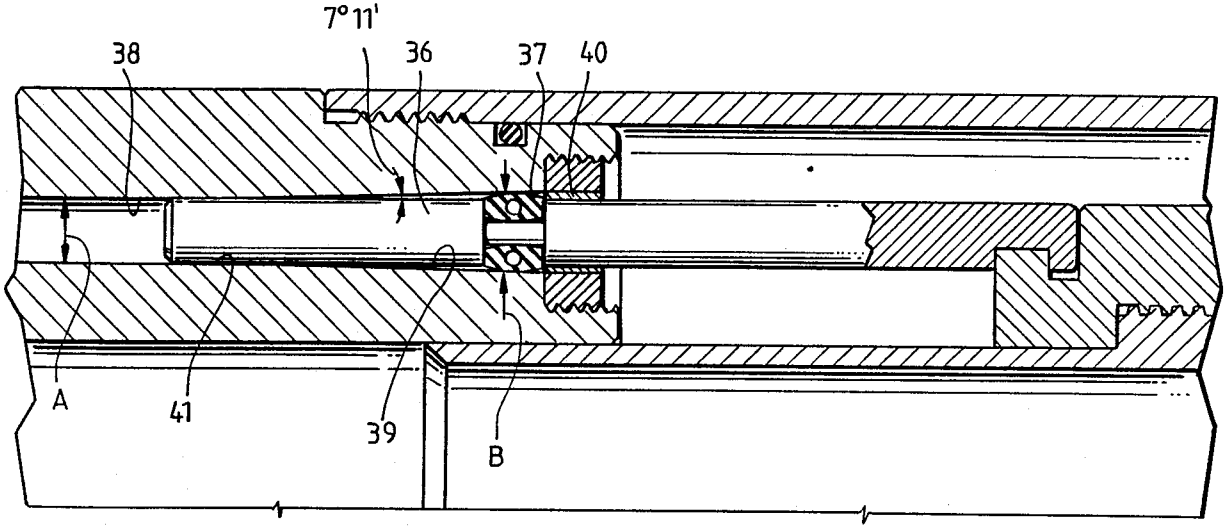
FIG. 2 is an enlarged fragmentary, cross-sectional view, taken from the section A of FIG. 1A.

Referring now to FIG. 2, the present invention is shown incorporated in the valve 10 of FIGS. 1A and 1B. The hydraulic working area increases as the valve opens such as by providing a taper in the hydraulic assembly 34. In the embodiment shown in FIG. 2, a tapering surface 39 is provided on one of the piston 36 or cylinder 38, here shown as being on the cylinder 38 The taper 39 is in the direction to increase the cross-sectional area exposed to the hydraulic fluid in the line 32 as the valve 10 opens. As shown in the numerical example given on the drawing, the hydraulic cross-sectional area at section A is 0.196 square inches as in a conventional valve, but the cross-sectional area at section B, upon closure of the valve 10, is 0.296 square inches for an increase in area of 0.100 square inches from close to open for a flow tube 22 travel of 4.5 inches. The seal 37 is flexible or expandable, such as resilient elastomer seal, which can expand as it moves from the close position at section A to the open position at section B. Preferably, a support bearing 40 is provided to support the seal 37 when the valve 10 is in the open position. In the example given the angle of taper is approximately 7° 11', and bearing length 41 is provided to prevent cocking. Using the figures shown on the drawing in FIG. 2, ignoring the effects of tubing pressure (which should be ignored for design purposes) both the closing pressure above the seal 37 and the opening pressure above the seal 37 is 816 psi. Of course, both the opening pressure and the closing pressure must be greater than the hydrostatic pressure of 800 psi.

This result is achieved because of the change in cross-section of the working area of the assembly 34. That is, assuming the valve 10 to be in the closed position, the force of the spring 26 increases against the assembly 34 as the valve moves from the closed to the open position. However, the hydraulic area to which the seal 37 is exposed also increases as the valve moves from the closed to the open position thereby allowing the hydraulic opening pressure to overcome the spring rate per inch of travel of the biasing spring 26. Once the valve starts moving to the open position, additional pressure is not required, only additional volume, as an additional open force is provided with the same pressure because of an increase in the working area of the hydraulic assembly 34. And when the valve 10 is moved from the open position to the closed position, the cross-sectional area acting on the seal 37 decreases which decreases the hydrostatic head force acting against the biasing spring 26 thereby allowing closure to be made even though the spring output force decreases as the valve strokes to the closed position.

And, assuming the example given above, the valve 10 in FIG. 2 will open by applying a hydraulic force at the well surface of only 16 psi. Therefore, this reduces the surface operating pressure problem, allows the use of a cheaper spring, and shortens and reduces the cost of the safety valve.

Other and further embodiments may be provided, as hereinafter described, wherein like parts to those shown in FIG. 1A, 1B and 2 will be similarly numbered with the addition of the suffix "a", "b" and "c".

Figure 4:
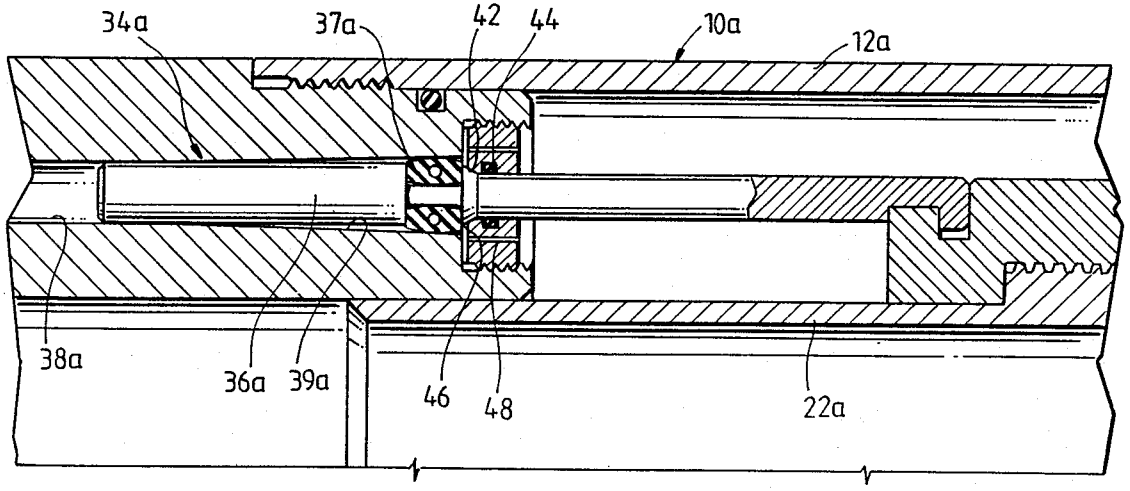
FIG. 4 is an enlarged fragmentary, cross-sectional view of another embodiment of the hydraulic actuator of the present invention.

Referring now to FIG. 4, the safety valve **10*a* includes a hydraulic piston and assembly 34*a* including a piston 36*a* movable in a cylinder 38*a* having a tapered surface 39*a*. This embodiment includes a metal downstop and debris barrier 42 having a wiper ring. The downstop 42 engages a shoulder 46 on the piston 36*a* for providing a stop. The stop 42 includes a filter equalizing hole or weep hole 48 for allowing the seal 37*a* to be the seal controlling the variable surface area as the valve 10*a*** is actuated.

Figure 5:
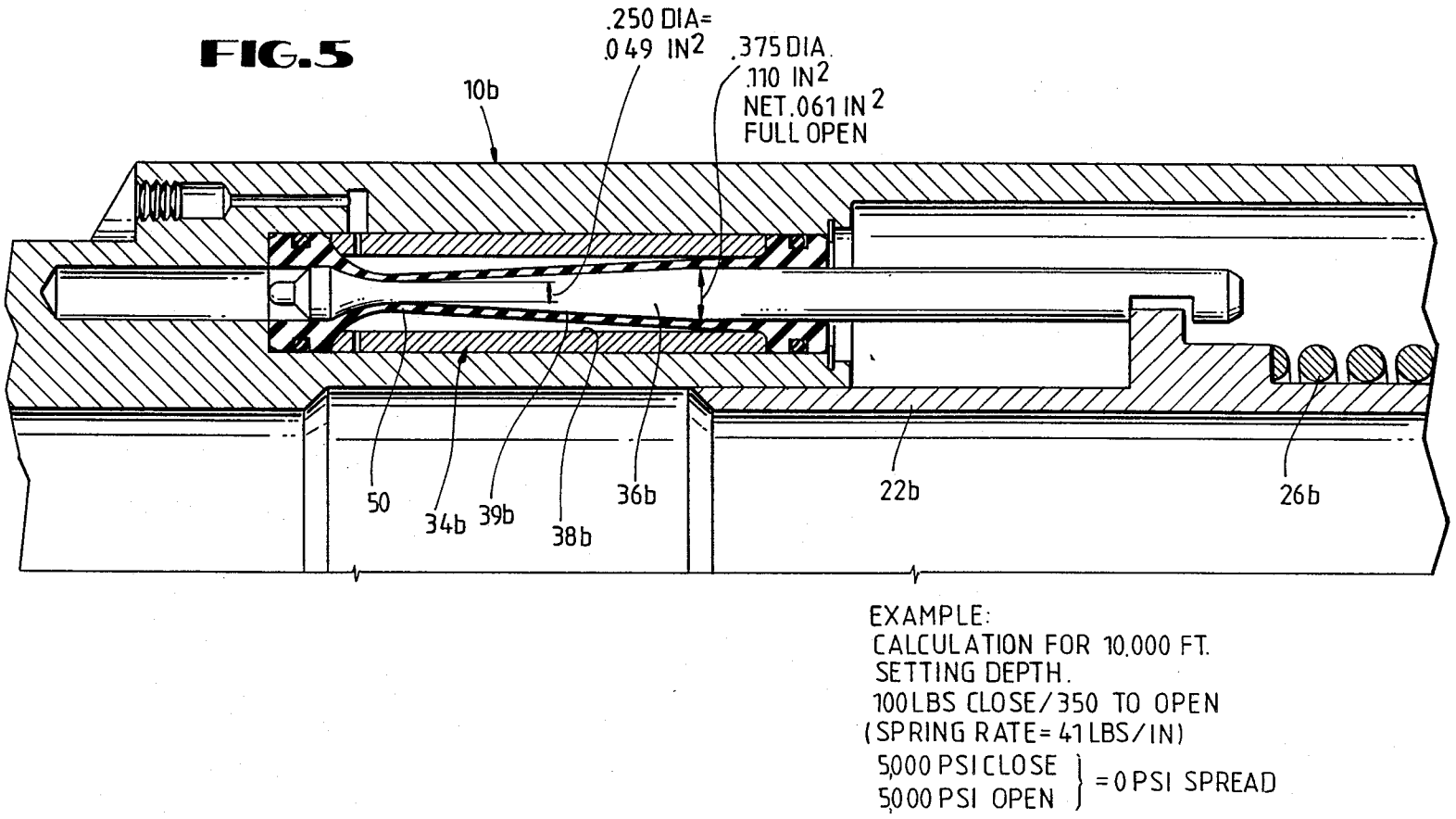
FIG. 5 is an enlarged fragmentary, cross-sectional view of still a further embodiment of the present invention.

Referring now to FIG. 5, a further embodiment of safety valve **10*b* is shown in which a piston 36*b* is movable in a cylinder 38*b* in which the piston 36 includes a tapered outer surface 39*b*. A flexible sleeve 50, such as a material sold under the trademark "Teflon" or including a composite plastic with or without metal ribs is positioned between the piston 36*b* and the cylinder 38*b*. The outer portion of the sleeve 50 is exposed to control hydraulic fluid. Therefore, pressurized fluid on the exterior of the sleeve 50 acts on the tapered piston 36*b* to move it downwardly and open the valve with an increasing cross-sectional area being exposed in the assembly 34*b*** to the control fluid. The calculations shown on the drawing again indicate that by proper selection of the values that the spread between open and close can be 0 psi.

Figure 6:
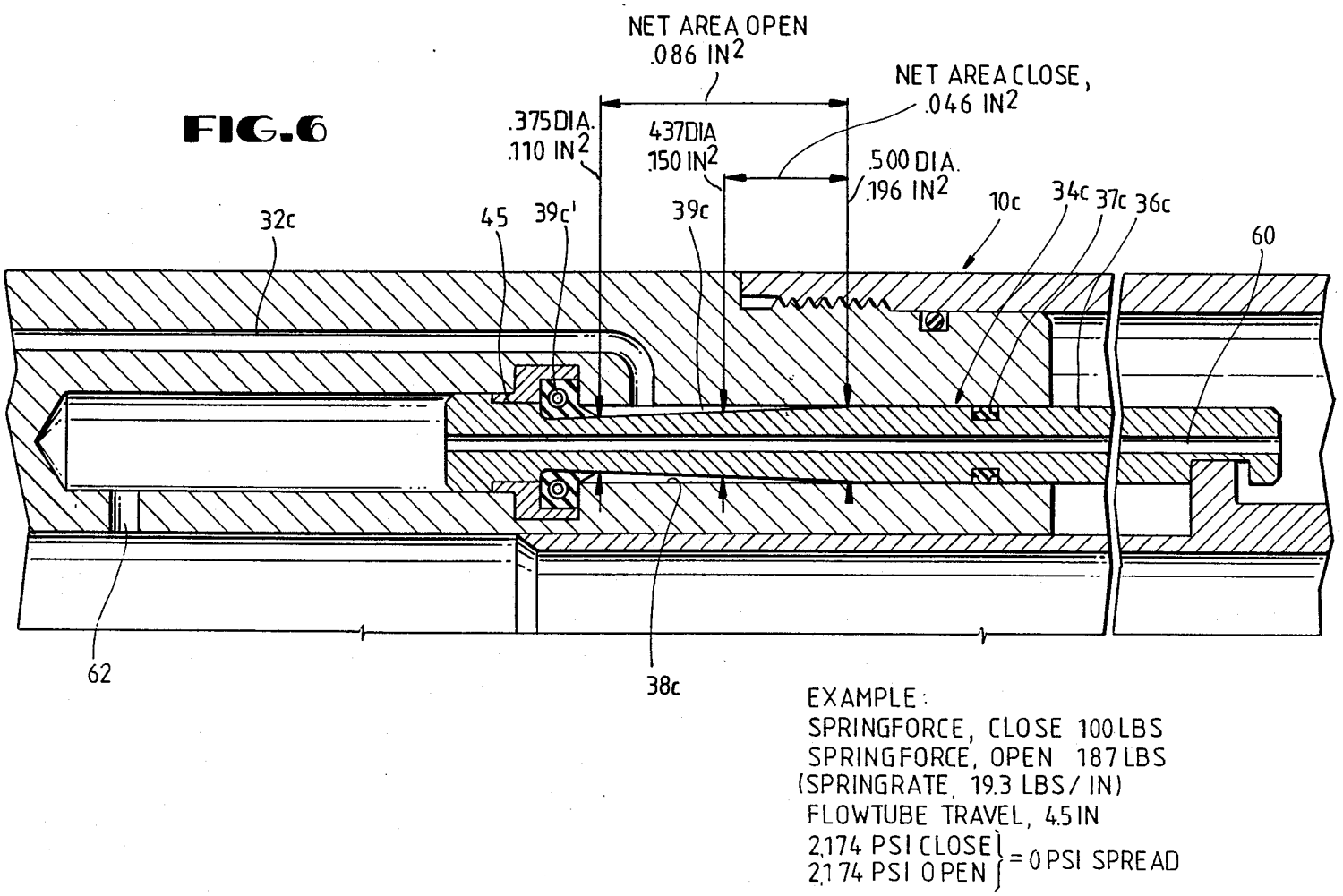
FIG. 6 is a fragmentary enlarged, cross-sectional view of still a further embodiment of the present invention.

Referring still to a further embodiment, in FIG. 6, a safety valve **10*c* is illustrated having a piston 36*c* movable in a cylinder 38*c* of a hydraulic piston and cylinder assembly 34*c*. In this embodiment, the rod piston 36*c* includes a tapered surface 39*c* with a first seal 37*c* and a second seal 39*c*. The seals 37*c* and 39*c* act between the piston 36*c* and the cylinder 38*c* on opposite sides of the hydraulic control fluid line 32*c*. The piston 36*c* may include an opening 60 or an optional tubing pressure inlet 62 may be provided with a solid piston 34*c*, for allowing the tubing pressure to act against the top of the piston 34*c*. The application of pressurized hydraulic fluid in the line 32*c* acts on the tapered surface 39*c* to move the piston 36*c* downwardly for opening the safety valve 10*c*. A metal downstop 45 is provided to engage piston 36*c* to prevent the possible extrusion of seal 39*c* upon full opening of valve 10*c*. However, the stop 45 consists of a plurality of flutes which will not seal and undesirably change the seal area at seal 39*c***. Again, numerical examples for setting depth of 3,500 to 4,000 ft. at 0.5 psi/ft. are given as to the sizing of the tapered areas that open and close to indicate that the spread again may be made zero for the example given.

Thus, the principal of using a variable area hydraulic actuator such as having tapered hydraulics can be utilized in many different types of well tools such as setting packer elements where additional pounds of force are required in a minimum amount of space. Also, opening of circulating valves that may or may not have spring return to the closed position can utilize the present invention. It is also to be noted that while the present invention has been described in connection with rod type piston and cylinder assemblies, that concentric hydraulic chamber designs, that is, utilizing two seal diameters of different dimensions around the center line of a tool, for example in a Camco TRB-8 safety valve, may be tapered to achieve desirable results.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts, will readily suggest themselves to those skilled in the art and which are encompassed within the spirit of the invention and the scope of the appended claims.

What is claimed is:

1. In a subsurface well tool having a housing and a hydraulic piston and cylinder assembly actuator, the improvement in the actuator comprising, said piston and cylinder assembly adapted to be connected to a hydraulic control line extending to the well surface, said cylinder assembly including an inlet connected to said hydraulic control line, and said assembly having a cross-sectional area exposed to hydraulic fluid in the control line, said area increasing in one direction of movement of the assembly and decreasing in the opposite direction.

2. The apparatus of claim 1 wherein one of the piston and cylinder includes a tapered surface.

3. The apparatus of claim 2 including a seal between the piston and cylinder and the cylinder includes a tapered surface.

4. The apparatus of claim 2 including a seal between th piston and cylinder and the piston includes a tapered surface.

5. The apparatus of claim 1 wherein the cross-sectional area exposed to the hydraulic fluid in the control line increases in a direction extending away from the inlet.

6. The apparatus of claim 1 wherein the well tool includes a valve moving between the open and closed position by the actuator and wherein the cross-sectional area exposed to the hydraulic fluid in the control line increases in the direction of opening of the valve by the actuator.

7. The apparatus of claim 1 wherein one of the piston and cylinder includes a tapered surface and including a seal between the piston and cylinder on opposite sides of the inlet.

8. The apparatus of claim 1 wherein one of the piston and cylinder includes a tapered surface and including a flexible hydraulic diaphragm positioned between the piston and cylinder.

9. The apparatus of claim 1 including biasing means yieldably urging the assembly in the second direction.

10. A subsurface well safety valve for controlling fluid flow through a well conduit comprising, a housing having a bore and a valve closure member in the bore moving between open and closed positions for controlling fluid flow through the bore, a tubular member telescopically movable in the housing for controlling the movement of the valve closure member, biasing means for moving the tubular member in a direction to close the valve, a piston and cylinder assembly in the housing contacting and moving the tubular member, said assembly adapted to be connected to a hydraulic control line extending to the well surface, said assembly having a cross-sectional area exposed to hydraulic fluid in the control line, said area increases in the direction of movement of the assembly in opening the valve and decreases in the opposite direction.

11. The apparatus of claim 10 wherein one of the piston and cylinder includes a tapered surface.

12. The apparatus of claim 11 including a flexible seal between the piston and cylinder.

13. The apparatus of claim 11 wherein the cylinder includes a tapered surface.

14. The apparatus of claim 13 including a flexible seal on the piston.

* * * * *